US008362961B2

(12) United States Patent
Gualtieri

(10) Patent No.: US 8,362,961 B2
(45) Date of Patent: Jan. 29, 2013

(54) MODULATED ANTENNA FOR WIRELESS COMMUNICATIONS

(75) Inventor: Devlin M. Gualtieri, Ledgewood, NJ (US)

(73) Assignee: Honeywell International Inc., Morristown, NJ (US)

( * ) Notice: Subject to any disclaimer, the term of this patent is extended or adjusted under 35 U.S.C. 154(b) by 586 days.

(21) Appl. No.: 12/611,707

(22) Filed: Nov. 3, 2009

(65) Prior Publication Data

US 2011/0102286 A1 May 5, 2011

(51) Int. Cl.
*H01Q 11/12* (2006.01)

(52) U.S. Cl. ..... 343/742; 343/741; 343/867

(58) Field of Classification Search ..... 343/741, 343/742, 853, 867
See application file for complete search history.

(56) References Cited

U.S. PATENT DOCUMENTS

| | | | | |
|---|---|---|---|---|
| 3,735,409 | A * | 5/1973 | Gershberg et al. | 342/363 |
| 3,788,647 | A * | 1/1974 | Evans | 473/223 |
| 4,093,952 | A * | 6/1978 | Taylor | 342/413 |
| 4,219,821 | A * | 8/1980 | Selim | 342/445 |
| 5,437,057 | A * | 7/1995 | Richley et al. | 455/41.1 |
| 6,903,702 | B2 * | 6/2005 | Kawai et al. | 343/793 |
| 6,941,204 | B2 | 9/2005 | Halm et al. | |
| 7,249,711 | B1 | 7/2007 | Steinbrecher | |
| 2006/0132301 | A1 | 6/2006 | Stilp | |
| 2006/0164248 | A1 | 7/2006 | Vossiek | |

FOREIGN PATENT DOCUMENTS

| | | |
|---|---|---|
| EP | 1675041 | 6/2006 |
| WO | 2008104487 | 9/2008 |
| WO | 2008118019 | 10/2008 |

* cited by examiner

*Primary Examiner* — Tho G Phan
(74) *Attorney, Agent, or Firm* — Fogg & Powers LLC

(57) ABSTRACT

A system comprises a first sensing device, a first Sterba Curtain, and a first modulating device communicatively coupling the first sensing device to the first Sterba Curtain. The first sensing device is configured to sense at least a first parameter. The first Sterba Curtain is configured to receive at least a first incident electromagnetic wave and to selectively transmit and reflect portions of the first incident electromagnetic wave. The first modulating device is configured to selectively convey a first signal representing the first parameter by modulating at least one of a first transmitted component of the first incident electromagnetic wave and a first reflected component of the first incident electromagnetic wave.

18 Claims, 6 Drawing Sheets

MODULATED ANTENNA FOR WIRELESS COMMUNICATIONS

BACKGROUND

Wireless sensors are preferred for many applications because they can be deployed quickly and without wiring. The absence of wiring makes wireless sensors especially favored in applications where low weight is important, such as in aircraft applications. Wireless sensors typically contain an integral power supply, such as a battery and/or an energy-harvesting device, or other suitable power supply. Components related to signal transmission generally consume more power than other components in wireless sensor systems.

Some common wireless sensors include both a receiver and a transmitter. In these wireless sensors, the sensor's receiver is interrogated by another wireless device. The other wireless device requests that the sensor transmit data. The sensor's receiver receives the request to transmit data and the data is transmitted using the sensor's transmitter. While it is not necessary that the transmitter always be powered on, the receiver is typically powered on to receive requests because receivers are typically not aware of when a request will be received. Thus, the receiver is typically powered on, such that the sensor can receive the interrogation requests from the other device. In addition, the transmitter uses a relatively large amount of power when it transmits data from the sensor, relative to the total power usage of the sensor.

SUMMARY

A system comprises a first sensing device, a first Sterba Curtain, and a first modulating device communicatively coupling the first sensing device to the first Sterba Curtain. The first sensing device is configured to sense at least a first parameter. The first Sterba Curtain is configured to receive at least a first incident electromagnetic wave and to selectively transmit and reflect portions of the first incident electromagnetic wave. The first modulating device is configured to selectively convey a first signal representing the first parameter by modulating at least one of a first transmitted component of the first incident electromagnetic wave and a first reflected component of the first incident electromagnetic wave.

DRAWINGS

Features of the present invention will become apparent to those skilled in the art from the following description with reference to the drawings. Understanding that the drawings depict only typical embodiments of the invention and are not therefore to be considered limiting in scope, the invention will be described with additional specificity and detail through the use of the accompanying drawings, in which.

DETAILED DESCRIPTION

Figure 1:
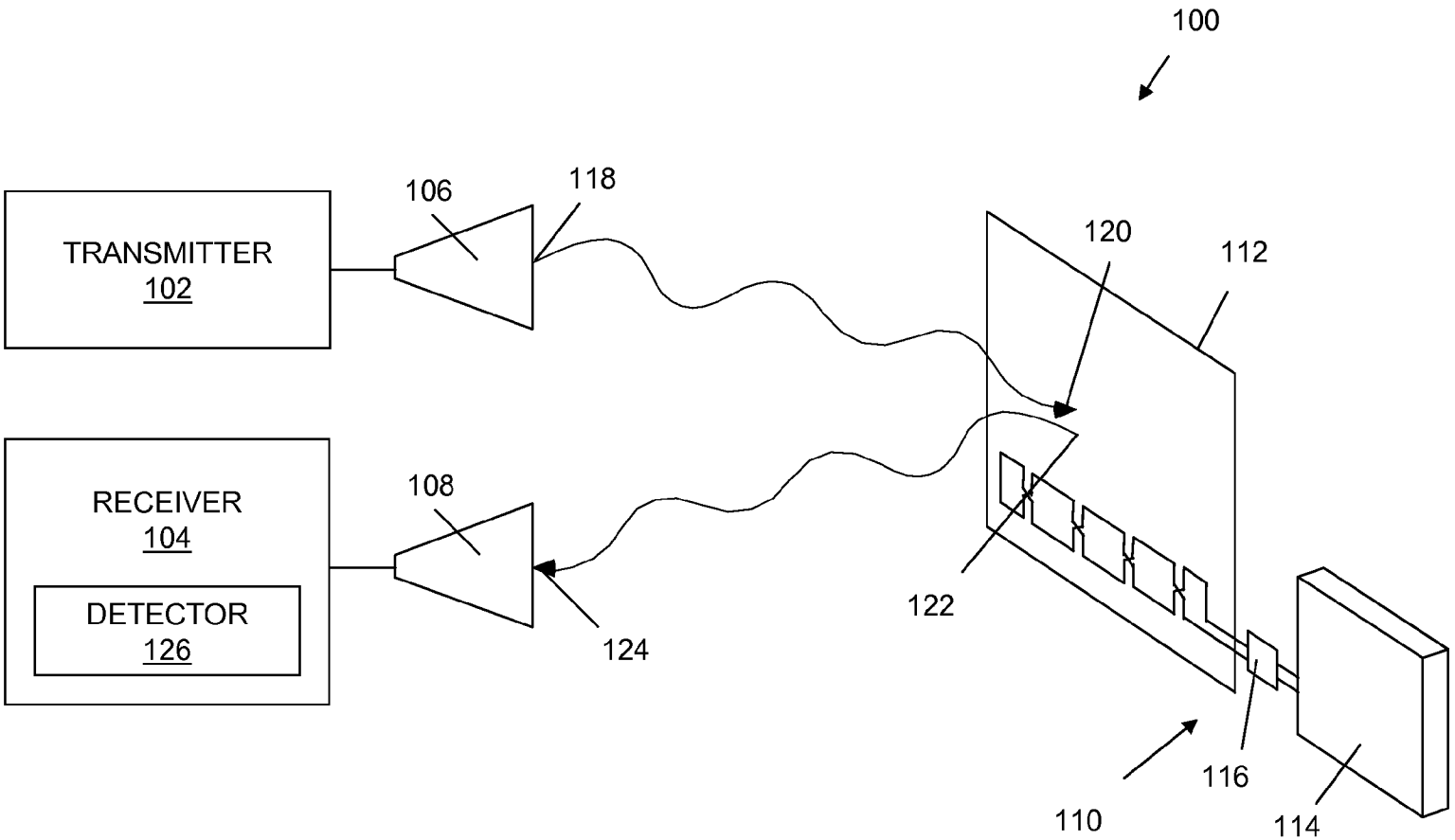
FIG. 1 is a diagram of one embodiment of a system for modulating sensor data in a reflection mode using the reflected component of an incident wave.

In the following detailed description, embodiments are described in sufficient detail to enable those skilled in the art to practice the invention. It is to be understood that other embodiments may be utilized without departing from the scope of the present invention. The following detailed description is, therefore, not to be taken in a limiting sense.

The present invention is directed to systems and methods for modulating sensor data onto waves. A low power system for transmission of data from wireless sensors is described. Specifically, an antenna array, such as a Sterba Curtain, receives incident waves from interrogating transmitters. A modulating device, such as a field-effect transistor ("FET"), bipolar junction transistor ("BJT"), diode, or other device, modulates sensor data using the reflected component and/or transmitted component of an incident wave. The present approach uses a modulating device, such as a field-effect transistor ("FET"), to modulate sensor data onto an incident wave that strikes an antenna array, such as a Sterba Curtain. A portion of the modulated incident wave is transmitted, while another portion of the modulated incident wave is reflected. The transmitted and/or reflected components of the modulated incident wave are received at a receiver via an antenna. The receiver has a detector that demodulates the sensor data from the received modulated wave.

This results in the ability to transmit sensor data from a sensor without using a transmitter. This helps to reduce the power requirement on the sensor for data communication, thus allowing sensor devices with small power sources, such as batteries, to last longer and/or require fewer battery changes. Each sensor can be used in either a reflection or transmission mode as described below. The reflection mode modulates the reflected component of an incident wave, while the transmission mode modulates the transmitted component of the incident wave. When used in a reflection mode, the reflected component of the modulated incident wave is received at a receiver positioned on the same side of the antenna array as the transmitter. When used in a transmission mode, the transmitted component of the modulated incident wave is received at a receiver positioned on a side of the antenna array opposite the transmitter.

In example embodiments implementing the transmission mode, a single wave transmitted from a transmitter can pass through multiple sensors arranged in a linear, serial arrangement before reaching the receiver. In these example embodiments, sensor data can be modulated using the transmitted component of the modulated incident wave at each sensor. The transmitted modulated wave, or components of it, is repeatedly passed onto the next sensor in the linear arrangement until it reaches the receiver. Sensor data from multiple sensors can be modulated using the wave as it passes through the sensors placed in a line between the transmitter and the receiver. One embodiment utilizing this multi-sensor linear arrangement in a transmission mode is where a single wave is emitted by a transmitter and transmitted through multiple sensors on an aircraft wing and received at a receiver on the other side of the wing.

FIG. 1 is a diagram of a system 100 for modulating sensor data in a reflection mode using the reflected component of an incident wave. The system 100 includes a transmitter 102 and a receiver 104. The transmitter 102 transmits radio frequency waves, or other electromagnetic waves, through an antenna 106, while the receiver 104 receives radio frequency waves, or other electromagnetic waves, through an antenna 108. The antenna 106 and antenna 108 can be of any suitable antenna type, such as a Sterba Curtain, helical antenna, dipole antenna, Yagi antenna, or loop antenna. The system 100 also includes a sensor 110 comprising a sensing device 114 and an antenna array 112. In the embodiment shown, the antenna array 112 is a Sterba Curtain, though other suitable antennas may also be used, such as a loop antenna. Characteristics of suitable antennas are discussed below.

The sensing device 114 is operatively coupled to the antenna array 112 by modulating device 116. Modulating device 116 modulates the reflectivity and/or transmittance of the antenna array 112 by alternatively opening and closing the antenna loop, such that the antenna becomes less or more reflective. This is described in detail with reference to FIG. 3 below. The sensing device 114 typically includes a microprocessor and at least one component which senses at least one parameter. In some implementations, the sensing device 114 includes a plurality of parameter sensing components which sense a variety of parameters, such as air temperature, air pressure, air velocity, inertial motion, velocity, acceleration, the status of valves (such as whether valves are opened or closed), the status of mechanical and electrical components in a wing or other part of an aircraft (such as the position of flaps, ailerons, and other control surfaces), the status of the landing gear (such as whether switches indicate that the landing gear is up or down), and whether or not there is ice on the wings and control surfaces of the aircraft. In addition, the sensing device 114 includes a power source, such as a battery or energy-harvester. The sensing device 114 typically senses data using the parameter sensing component and then modulates the sensed data using the reflected component and/or transmitted component of an incident wave using the antenna array 112 and a modulating device 116 as described below. The power source provides power to the sensing device 114 and the modulating device 116.

Figure 2:
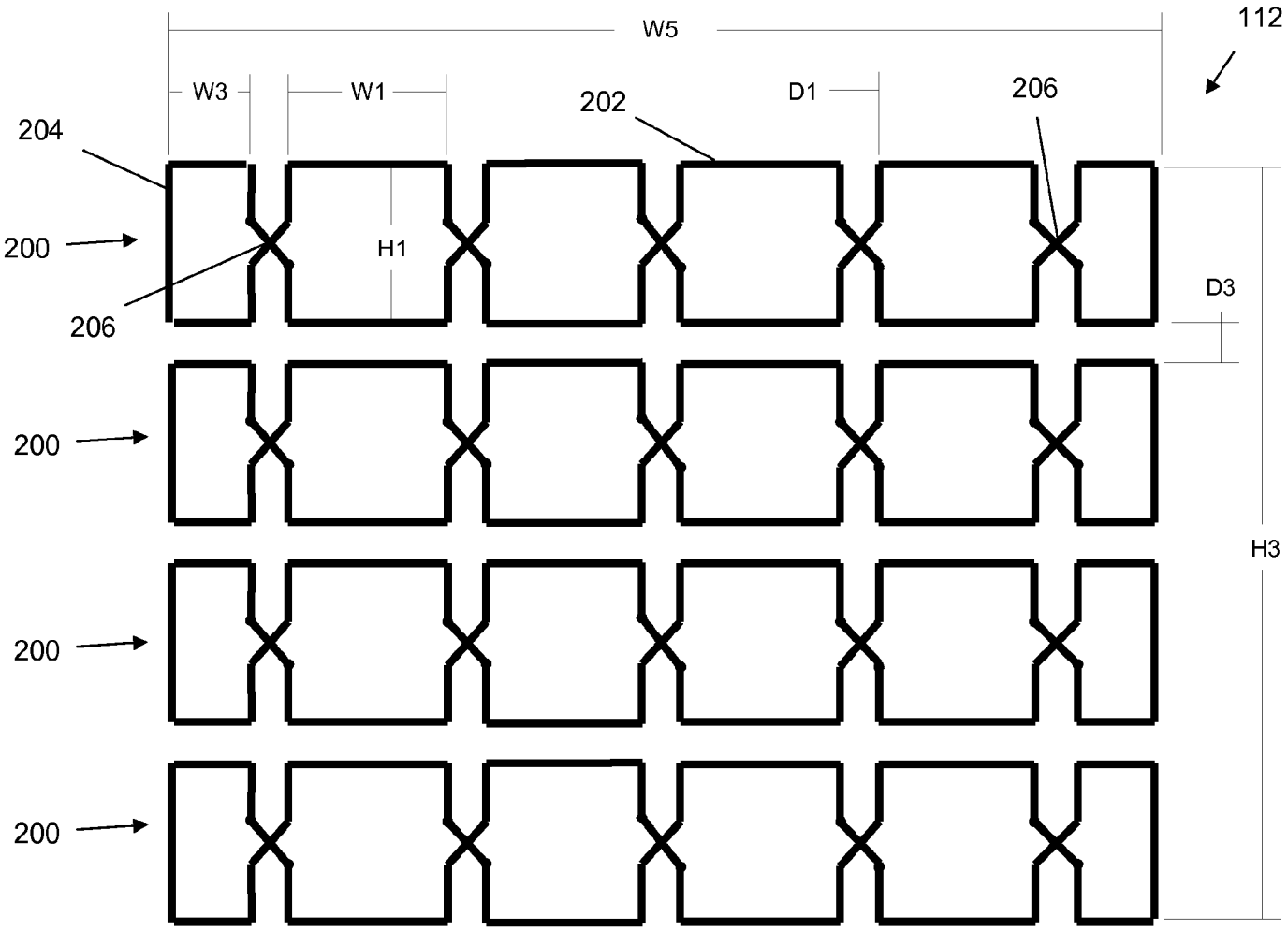
FIG. 2 is a schematic diagram of one embodiment of a Sterba Curtain.

FIG. 2 shows a schematic diagram of the antenna array 112, which is a Sterba Curtain. A Sterba Curtain is a loop array antenna including at least one twisted wire loop. In many embodiments, including the embodiment shown in FIG. 2, a number of main loops 200 are included having similar elements. Each of the main loops 200 is twisted to create a number of smaller full-loops 202 and a number of smaller half-loops 204. Each of the full-loops 202 in the Sterba Curtain has a width W1 of about one half wavelengths. Each of the smaller half-loops 204 at the ends of the Sterba Curtain has a width W3 of about one quarter wavelengths. The height H1 of both the full-loops 202 and the half-loops 204 in the Sterba Curtain are at least about one half wavelengths. These dimensions make the Sterba Curtain appropriate for reception and reflection at a desired frequency. The full-loops 202 and half-loops 204 are separated by a number of crossover points 206. At the crossover points 206, twisted main loop 200 crosses over itself to form boundaries between the full-loops 202 and the half-loops 204.

When a main loop 200 of the Sterba Curtain is used as an antenna in other applications, the feed point is at any one of the four outer corners of main loop 200. A main loop of the Sterba Curtain will act as a reflector when the antenna is shorted as shown in FIG. 2. When a main loop 200 of the Sterba Curtain is open, its radar cross-section is relatively small because the open-loop Sterba Curtain has a radar cross section similar to a collection of wires. When a main loop 200 of the Sterba Curtain loop is closed, its radar cross-section is relatively large. Said another way, the ratio of reflectivity between the closed-loop Sterba Curtain and the open-loop Sterba Curtain is large. Because of the closed-loop construction of the Sterba Curtain, a main loop 200 of the Sterba Curtain takes the radio waves it receives and converts the radio waves into currents through the wire. Because of the way the wire in each main loop 200 is bent and twisted, the wire in a main loop 200 of the Sterba Curtain makes out-of-phase signals at certain points and in-phase signals at certain points, which leads to reflectivity. Thus, a switch positioned in a main loop 200 can effectively modulate the radar cross-section of the Sterba Curtain. Switching can be accomplished using a field-effect transistor ("FET") or suitable modulating device as described below.

Using this simple switch modulation, digital data, or another digital signal, can be modulated using the reflectivity and/or transmittance of the Sterba Curtain. In example embodiments, a digital-one could be represented by the presence of the reflected/transmitted signal at a receiver, while a digital zero could be represented by the absence of the reflected/transmitted signal at a receiver. A reflected/transmitted signal could be determined to be present if the received signal was above a particular threshold. Similarly, a reflected/transmitted signal could be determined to be absent if the received signal was below a particular threshold. While digital transmission using a switch to modulate the reflected component and/or transmitted component of an electromagnetic wave is described herein, it is also contemplated that other methods could also be used, such as modulation of an analog signal onto a reflected/transmitted wave.

While other antennas can also be modulated in a similar way, the advantage with the Sterba Curtain is the high ratio of reflectivity between the closed-loop and open-loop Sterba Curtain. While it is also possible to modulate reflectivity/transmittance using helical antennas by shorting the helix to the ground plane, there would be little ability to modulate because the ratio of reflectivity between closed-loop and open-loop in helical antennas is not very high. The ratio of reflectivity is not very high in a helical antenna because the ground plane of a helical antenna has a large radar cross-section itself, without being shorted. It would be difficult to discern between a digital-one (high signal) and a digital-zero (low signal). Likewise, both dipole and Yagi antennas would be ineffective since the open-loop components of the antenna, such as the reflector and director of the Yagi antenna, have large radar cross-sections by themselves, thus allowing for little ability to modulate. A simple loop antenna can be modulated effectively, as it is similar to a Sterba Curtain on a smaller scale. Still, the Sterba Curtain is preferred because of its higher ratio of closed-loop reflectivity to open-loop reflectivity.

The dimensions of the loops can be varied in order to tune the Sterba Curtain to various frequencies. For example, a Sterba Curtain tuned to 5.8 GHz requires each of the full-loops 202 in the Sterba Curtain to have a width W1 of about 1 inch to match a half wavelength, while each of the half-loops 204 has a width W3 of about ½ inch to match a quarter wavelength. Similarly, each of the full-loops 202 and the half-loops 204 have a height H1 of about 1 inch high to match a half wavelength. In addition, the Sterba Curtain tuned to 5.8 GHz has a distance D1 of about ¼ inch between each of the full-loops 202 and half-loops 204 in the horizontal direction and a distance D3 of about ¼ inch between each main loop 200 in the vertical direction. The required dimensions in a Sterba Curtain tuned to 5.8 GHz with four vertical rows of loops, as shown in FIG. 2, are relatively large—the entire Sterba Curtain having a width W5 of about 6¼ inches and a height H3 of about 4¾ inches.

While the Sterba Curtain is an effective type of antenna for this application, this is not obvious to those skilled in the art because the Sterba Curtain is generally disfavored due to its large size. A Sterba Curtain tuned to 5.8 GHz may be prohibitively large for some sensor applications. But, as Sterba Curtains are tuned to higher and higher frequencies, the dimensions shrink dramatically. For example, in a Sterba Curtain tuned to 61.25 GHz, each full loop only has a width W1 of about 1/10 inch to match a half wavelength, while each half loop only has a width W3 of about 1/20 inch to match a quarter wavelength. In addition, in a Sterba Curtain tuned to 61.25 GHz there is only a distance D1 of about 1/40 inch between loops in the horizontal dimension and only a distance D3 of about 1/40 inch between loops in the vertical dimension. Thus, the required dimensions in a Sterba Curtain tuned to 61.25 GHz and arranged as shown in FIG. 2 would only be about a total width W5 of about ⅝ inch and a total height H3 of about ½ inch. A Sterba Curtain tuned to 61.25 GHz requires less than one square inch of area, which is about 100 times smaller than a Sterba Curtain tuned to 5.8 GHz and on the same order of magnitude as typical sensors in use today.

Figure 3:
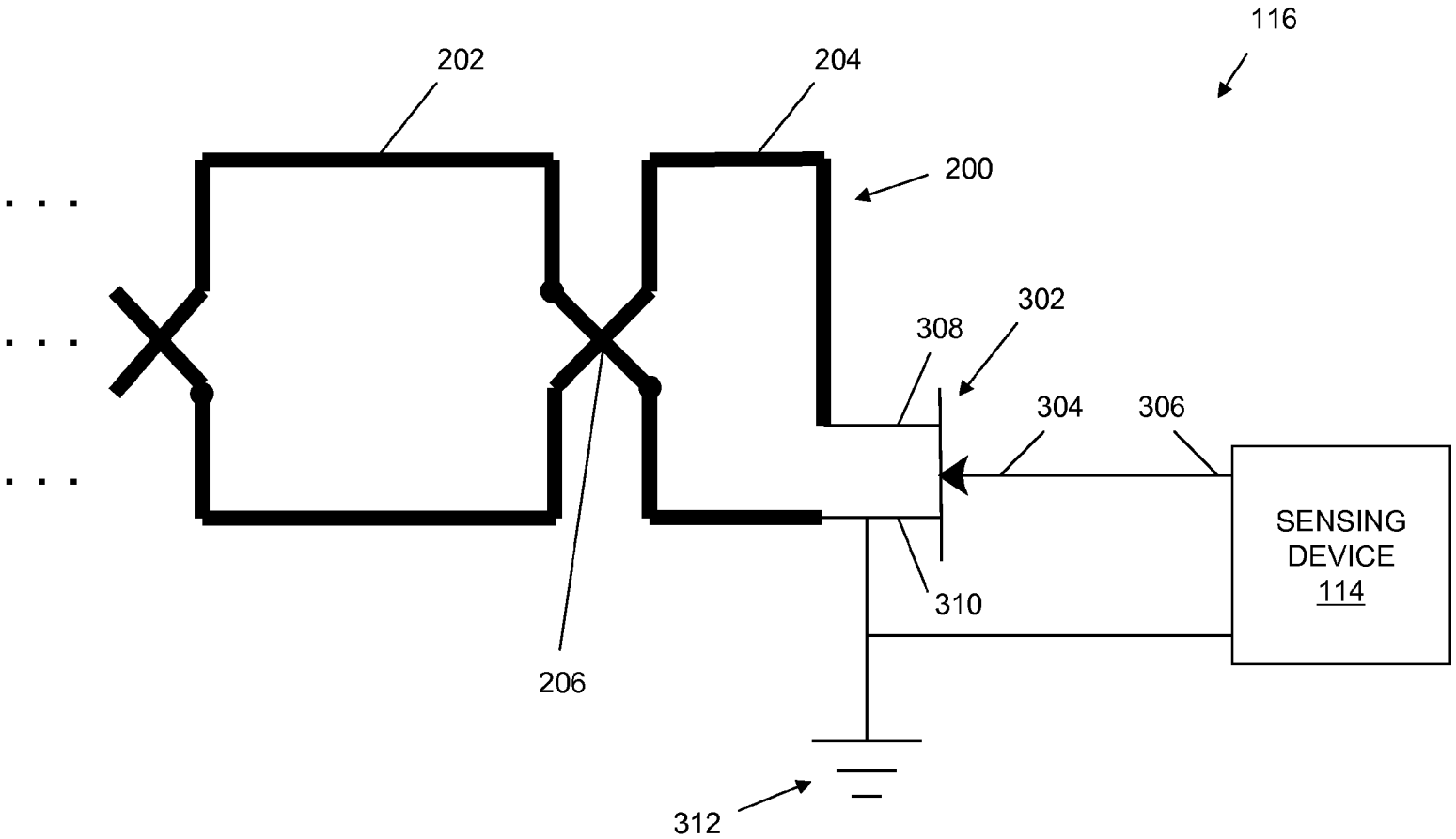
FIG. 3 is a detailed diagram of one embodiment of a modulating device between an antenna array and a sensing device used in modulation of the reflected component and/or transmitted component of an incident wave.

FIG. 3 is a detailed diagram of a modulating device 116 between the main loop 200 of an antenna array 112 (shown in FIGS. 1-2) and the sensing device 114. The modulating device 116 includes a field-effect transistor 302 communicatively coupling the antenna array 112 to the sensing device 114. The field-effect transistor 302 includes a gate terminal 304, a drain terminal 308, and a source terminal 310 as is commonly known in the art. The field-effect transistor 302 may also include a fourth base terminal used in biasing the field-effect transistor 302. While a field-effect transistor 302 is described in this embodiment, other transistors or other low power modulating devices may also be used to modulate the sensor data onto the wave.

The gate terminal 304 is coupled to an output 306 of the sensing device 114. One of the outer half-loops of the antenna array 112 is cut or disconnected such that the field-effect transistor 302 can interface with the antenna array. The drain terminal 308 is connected to a side of the cut outer half-loop of the antenna array 112. The source terminal 310 is connected to a second side of the cut outer half-loop of the antenna array 112. The source terminal 310 can be grounded to ground 312. Similarly, the sensing device 114 can be grounded to ground 312. While ground 312 is used in the embodiment shown in FIG. 3, other embodiments do not include ground 312. As a signal, such as digital data, is output from the sensing device 114 onto output 306, it controls the opening and closing of the field-effect transistor 302 and modulates the signal using the reflected component and/or transmitted component of the incident wave traveling through full-loops 202 and half-loops 204 of the antenna array 112.

The reflected component and the transmitted component of the incident wave are 180 degrees out of phase from one another, such that a detector receiving either the reflected component and/or the transmitted component would be preprogrammed to correctly detect the signal depending on whether it was operating in the reflection or transmission mode. While FIG. 3 only shows a single field-effect transistor 302 connected to a single main loop 200 of a Sterba Curtain, multiple field-effect transistors 302 can be used to modulate data using multiple main loops 200 on a Sterba Curtain. In embodiments utilizing multiple main loops 200 and multiple field-effect transistors 302, the same signal can be modulated by using the reflected component and/or transmitted component of incident waves traveling through multiple main loops 200. While these embodiments are larger in size, they may have improved performance over embodiments utilizing a single main loop 200.

During operation of system 100, transmitter 102 transmits an emitted wave, such as emitted wave 118 displayed in FIG. 1, toward antenna array 112 via antenna 106. As emitted wave 118 travels toward antenna array 112, some of the wave may be deflected or attenuated by obstacles, such that only a portion of the original emitted wave 118 arrives at the antenna array 112 as incident wave 120. Once incident wave 120 arrives at antenna array 112, data from sensing device 114 is modulated using the reflected component and/or transmitted component of incident wave 120. A portion of incident wave 120 is reflected back by antenna array 112 as reflected wave 124. In addition, a portion of incident wave 120 may also be transmitted through antenna array 112. As reflected wave 124 travels toward antenna 108, some of the wave may be deflected or attenuated by obstacles, such that only a portion of the original reflected wave 124 arrives at the antenna 108 and is received by receiver 104 as received wave 124. The receiver 104 includes a detector 126 that demodulates the sensor data from the received wave 124.

Figure 4:
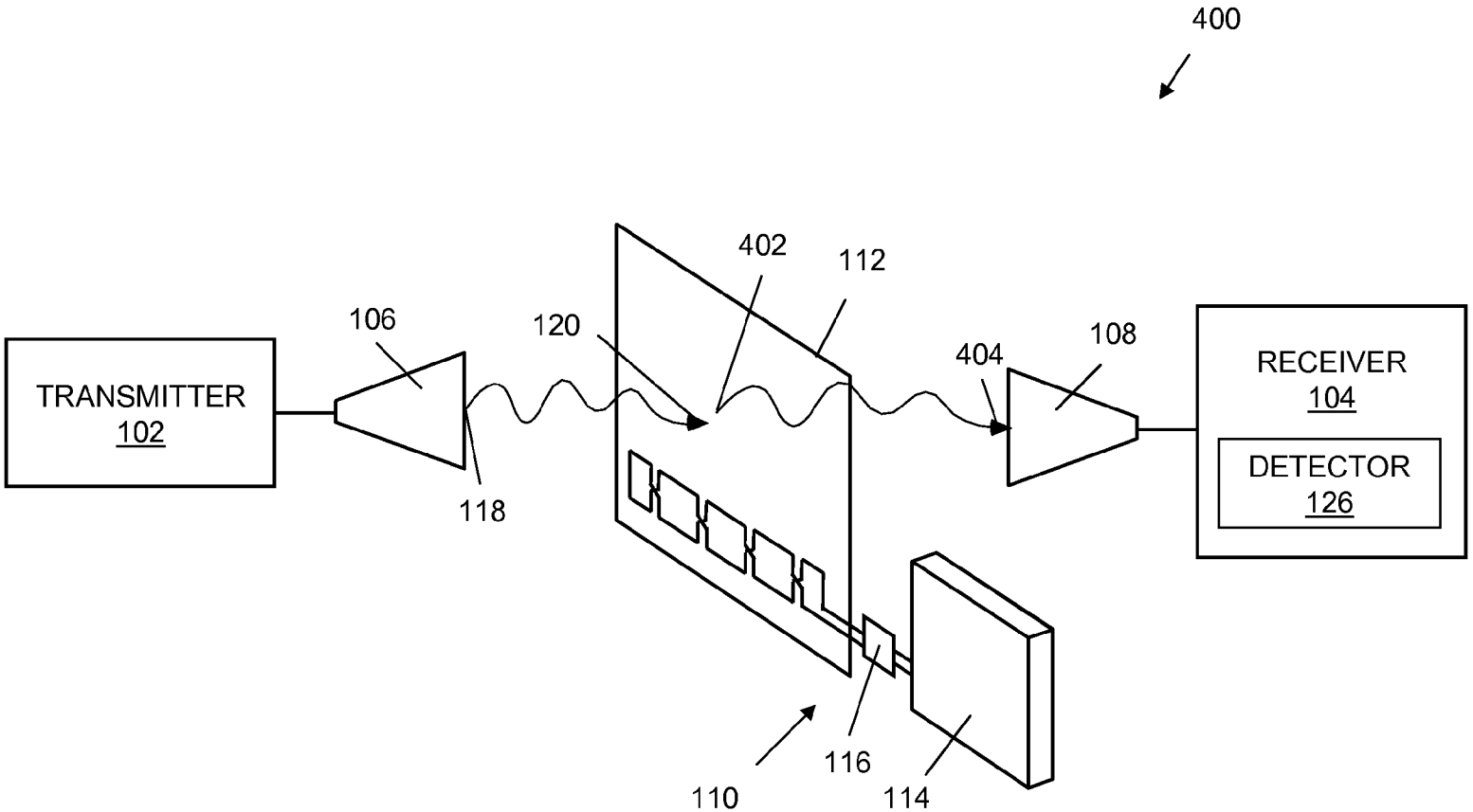
FIG. 4 is a diagram of one embodiment of a system for modulating sensor data in a transmission mode using the transmitted component of an incident wave.

FIG. 4 is a diagram of a system 400 for modulating sensor data in a transmission mode using the transmitted component of an incident wave. The system 400 includes the same components as system 100, with a few modifications. Specifically, the system 400 includes transmitter 102, receiver 104, antenna 106, antenna 108, and sensor 110 as described above. The sensor 110 includes antenna array 112, sensing device 114, and modulating device 116 as described above. The system 400 is different from system 100 in that the receiver 104 is positioned on an opposite side of the sensor 110 from the transmitter 102, such that the receiver 104 receives the transmitted modulated portion of the incident wave, instead of the reflected modulated portion of the incident wave. One application for system 400 utilizing this linear arrangement is in aircraft, where a single wave is emitted by a transmitter and transmitted through multiple sensors on an aircraft wing and received at a receiver on the other side of the wing.

During operation of system 400, transmitter 102 transmits an emitted wave, such as emitted wave 118 displayed in FIG. 4, toward antenna array 112 via antenna 106. As emitted wave 118 travels toward antenna array 112, some of the wave may be deflected or attenuated by obstacles, such that only a portion of the original emitted wave 118 arrives at the antenna array 112 as incident wave 120. Once incident wave 120 arrives at antenna array 112, data from sensing device 114 is modulated using the reflected component and/or the transmitted component of incident wave 120. A portion of incident wave 120 is transmitted through antenna array 112 as transmitted wave 402. In addition, a portion of incident wave 120 may be reflected back by antenna array 112. As transmitted wave 402 travels toward antenna 108, some of the wave may be deflected or attenuated by obstacles, such that only a portion of the original transmitted wave 402 arrives at the antenna 108 and is received by receiver 104 as received wave 404. The receiver 104 includes the detector 126 that demodulates the sensor data from the received wave 404.

Figure 5:
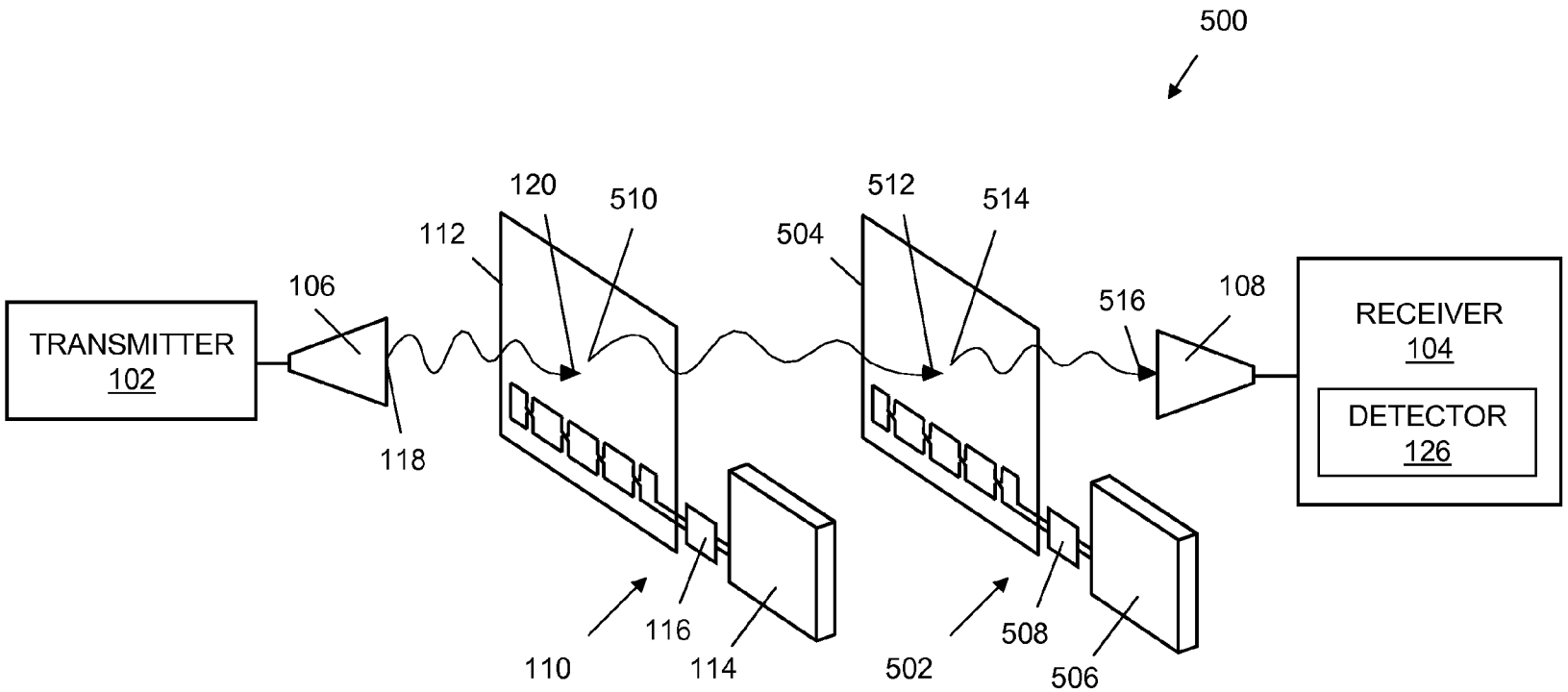
FIG. 5 is a diagram of one embodiment of a system for modulating multiple sensors' data in a transmission mode by modulating the transmitted component of incident waves.

FIG. 5 is a diagram of a system 500 for modulating multiple sensors' data in a transmission mode using the transmitted components of incident waves. The system 500 includes the same components as system 400, along with a few additional components. Specifically, the system 500 includes transmitter 102, receiver 104, antenna 106, antenna 108, and sensor 110 as described above. The sensor 110 includes the antenna array 112, sensing device 114, and modulating device 116 as described above.

In addition, the system 500 also includes a sensor 502 placed between sensor 110 and receiver 104. The sensor 502 is positioned between sensor 110 and antenna 108 connected to receiver 104, such that transmitter 102 is configured to emit a wave that travels linearly through both the sensor 110 and the sensor 502. The sensor 502 is similar to the sensor 110 described above and includes an antenna array 504, a sensing device 506, and a modulating device 508. The antenna array 504 is configured similarly to the antenna array 112, the sensing device 506 is configured similarly to the sensing device 114, and the modulating device 508 is configured similarly to the modulating device 116 described above. While the system 500 only includes two sensors, it is contemplated that greater amounts of sensors can be included between a single transmitter and receiver in similar systems.

During operation of system 500, transmitter 102 transmits an emitted wave, such as emitted wave 118 displayed on FIG. 5, toward antenna array 112 via antenna 106. As emitted wave 118 travels toward antenna array 112, some of the wave may be deflected or attenuated by obstacles, such that only a portion of the original emitted wave 118 arrives at the antenna array 112 as incident wave 120. Once incident wave 120 arrives at antenna array 112, data from sensing device 114 is modulated using the transmitted component of incident wave 120 by modulating device 116. A portion of incident wave 120 is transmitted through antenna array 112 as transmitted wave 510. In addition, a portion of incident wave 120 may be reflected back by antenna array 112.

As transmitted wave 402 travels toward antenna array 504, some of the wave may be deflected or attenuated by obstacles, such that only a portion of the original transmitted wave 510 arrives at the antenna array 504 as incident wave 512. Once incident wave 512 arrives at antenna array 504, data from sensing device 506 is modulated using the transmitted component of incident wave 512 by modulating device 508. A portion of incident wave 512 is transmitted through antenna array 504 as transmitted wave 514. In addition, a portion of incident wave 512 may be reflected back by antenna array 504.

As transmitted wave 514 travels toward antenna 108, some of the wave may be deflected or attenuated by obstacles, such that only a portion of the original transmitted wave 514 arrives at the antenna 108 and is received by receiver 104 as received wave 516. The receiver 104 includes the detector 126 that demodulates the sensor data from the received wave 516.

Generally, it is desirable that data from sensing device 506 is not modulated by modulating device 508 over data from sensing device 114 already modulated using modulating device 116. This can be accomplished in a number of ways. First, anti-collision algorithms can be used to reduce the possibility of overlapping modulation. Anti-collision algorithms may require each sensor to randomly transmit at a random data transmission time intervals. These random data transmission time intervals would be programmed so that they are substantially incommensurate with one another. If one of the modulating devices accidentally modulates at the same time as another, the incommensurate nature of the random timing would make it so that it would be a long time before the modulations overlapped again. In addition, error correcting code, such as checksums, may also be used to determine whether the data was corrupted by overlapping modulation, or for other reasons. Second, sensor 110 and sensor 502 could also include low power receivers, such that they could receive codes in the emitted signal that indicated when each sensor was allowed to modulate its data. Each sensor would only modulate data from its sensor in response to its pre-defined code. While these receivers would require power to operate, they would require much less power than a transmitter and would not be too much of a power drain on the battery source of sensor 110 or sensor 502.

Typically, data from sensing device 114 is modulated using the transmitted component of incident wave 120 by modulating device 116 at a different time from when data from sensing device 506 is modulated using the transmitted component of incident wave 512 by modulating device 508, such that the two signals will not be modulated on top of one another. In example implementations, data is modulated by modulating device 116 and modulating device 508 using a coded or encrypted signal, such that a decoder will only be able to decode the signal using the same code or encryption.

Figure 6:
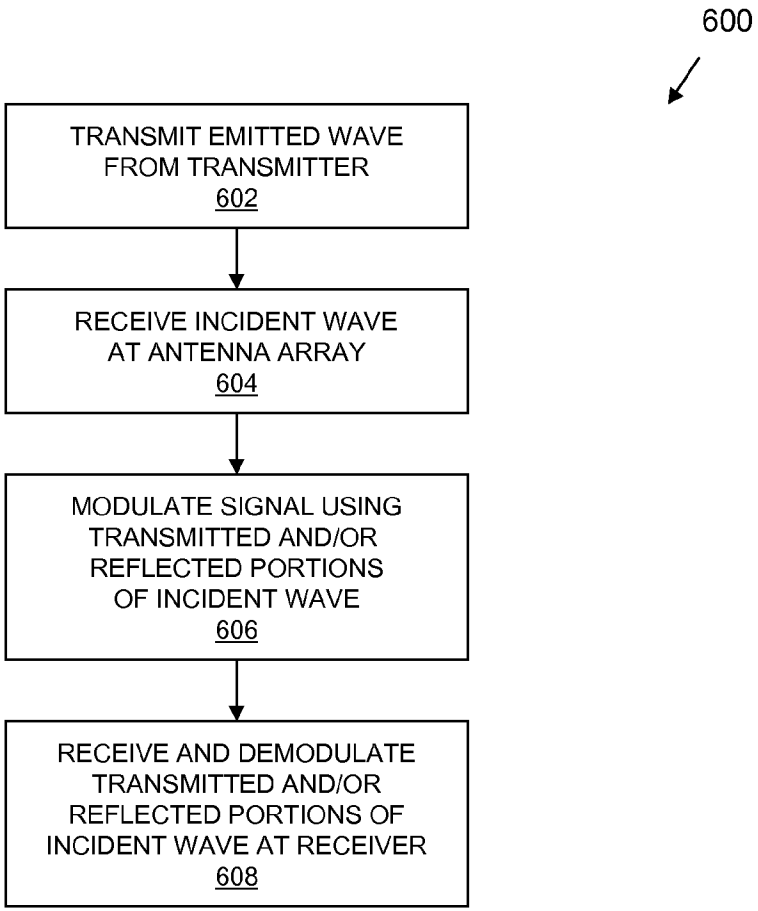
FIG. 6 is a flow diagram representing one embodiment of a method of modulating sensor data using the reflected component and/or reflected component of an incident wave.

FIG. 6 is a flow diagram representing a method 600 of modulating sensor data using the reflected component and/or transmitted component of an incident wave. At block 602, an emitted wave is transmitted from a transmitter. At block 604, an incident wave, comprising at least some of the emitted wave, is received at an antenna array. The antenna array may be a Sterba Curtain or other suitable antenna as described above. At block 606, a signal is modulated using the transmitted and/or reflected portions of the incident wave. The signal is modulated using a modulating device between a sensing device and an antenna array. The modulating device may comprise a FET or other suitable modulating device as described above. Specifically, the FET opens and closes the antenna array circuit, thereby modulating the reflected component and/or the transmitted component of the incident wave.

At block 608, the modulated transmitted and/or reflected portions of the incident wave are received and demodulated at a receiver to recover the signal. In particular embodiments, multiple sensors are arranged in a linear configuration, such that a single wave emitted from the transmitter passes through each of the sensors and the operations at block 604 and block 606 are repeated for each of the sensors before the operations at block 608 are performed.

The present invention may be embodied in other specific forms without departing from its essential characteristics. The described embodiments are to be considered in all respects only as illustrative and not restrictive. The scope of the invention is therefore indicated by the appended claims rather than by the foregoing description. All changes that come within the meaning and range of equivalency of the claims are to be embraced within their scope. Any features shown or described in one embodiment may be combined with, or replace, features shown in other embodiments.

What is claimed is:

1. A system comprising:

a first sensing device configured to sense at least a first parameter;

a first Sterba Curtain configured to receive at least a first incident electromagnetic wave, the first Sterba Curtain configured to selectively transmit and reflect portions of the first incident electromagnetic wave, wherein the first Sterba Curtain includes at least one main loop twisted to create a first number of smaller full-loops and a second number of smaller half-loops, wherein the first Sterba Curtain has substantially greater electromagnetic reflectivity when the at least one main loop of the first Sterba Curtain is closed than when the at least one main loop of the first Sterba Curtain is open; and a first modulating device communicatively coupling the first sensing device to the first Sterba Curtain, the first modulating device configured to alternatively open and close the at least one main loop of the first Sterba Curtain to change the electromagnetic reflectivity of the at least one main loop of the first Sterba Curtain to selectively convey a first signal representing the first parameter by modulating at least one of:

a first transmitted component of the first incident electromagnetic wave; and a first reflected component of the first incident electromagnetic wave.

2. The system of claim 1, further comprising:

a transmitter configured to transmit at least an emitted electromagnetic wave, wherein the first incident electromagnetic wave comprises at least a portion of the emitted electromagnetic wave; and a receiver configured to receive at least a received electromagnetic wave, wherein the received electromagnetic wave comprises at least a portion of at least one of:

the modulated first transmitted component of the first incident electromagnetic wave; and the modulated first reflected component of the first incident electromagnetic wave.

3. The system of claim 1, wherein the modulating device is at least one of a transistor and a diode.

4. The system of claim 3, wherein the modulating device is at least one of a field-effect transistor and a bipolar junction transistor.

5. The system of claim 1, further comprising:

a second sensing device configured to sense at least a second parameter;

a second Sterba Curtain configured to receive at least a second incident electromagnetic wave, the second Sterba Curtain configured to selectively transmit and reflect portions of the second incident electromagnetic wave, wherein the second Sterba Curtain includes at least a second main loop twisted to create a third number of smaller full-loops and a fourth number of smaller half-loops, wherein the second Sterba Curtain has substantially greater electromagnetic reflectivity when the at least the second main loop of the second Sterba Curtain is closed than when the at least the second main loop of the second Sterba Curtain is open; and a second modulating device communicatively coupling the second sensing device to the second Sterba Curtain, the second modulating device configured to alternatively open and close the at least the second main loop of the second Sterba Curtain to change the electromagnetic reflectivity of the at least the second main loop of the second Sterba Curtain to selectively convey a second signal representing the second parameter by modulating at least one of:

a second transmitted component of the second incident electromagnetic wave; and a second reflected component of the second incident electromagnetic wave.

6. The system of claim 5, further comprising:

a transmitter configured to transmit at least an emitted electromagnetic wave, wherein the first incident electromagnetic wave comprises at least a portion of the emitted electromagnetic wave; and a receiver configured to receive at least a received electromagnetic wave, wherein the received electromagnetic wave comprises at least a portion of the modulated second transmitted component of the second incident electromagnetic wave.

7. The system of claim 6, wherein the second incident electromagnetic wave comprises at least a portion of the modulated first transmitted component of the first incident electromagnetic wave or the first reflected component of the second incident electromagnetic wave.

8. The system of claim 5, wherein the second incident electromagnetic wave comprises at least a portion of the modulated first transmitted component of the first incident electromagnetic wave or the first reflected component of the second incident electromagnetic wave.

9. The system of claim 5, wherein the second signal is at a first logic level when the at least the second main loop of the second Sterba Curtain is open; and wherein the second signal is at a second logic level when the at least the second main loop of the second Sterba Curtain is closed.

10. The system of claim 5, wherein the second reflected component of the second incident electromagnetic wave is increased relative to the second transmitted component of the second incident electromagnetic wave when the at least the second main loop of the second Sterba Curtain is closed by the second modulating device.

11. The system of claim 5, wherein the second transmitted component of the second incident electromagnetic wave is increased relative to the second reflected component of the second incident electromagnetic wave when the at least the second main loop of the second Sterba Curtain is closed by the second modulating device.

12. The system of claim 5, wherein the second reflected component of the second incident electromagnetic wave is increased relative to the second transmitted component of the second incident electromagnetic wave when the at least the second main loop of the second Sterba Curtain is closed by the second modulating device; and wherein the second transmitted component of the second incident electromagnetic wave is increased relative to the second reflected component of the second incident electromagnetic wave when the at least the second main loop of the second Sterba Curtain is closed by the second modulating device.

13. The system of claim 12, wherein the first logic level is high when the second logic level is low and the second logic level is high when the first logic level is low.

14. The system of claim 1, wherein the first signal is at a first logic level when the at least one main loop of the first Sterba Curtain is open; and wherein the first signal is at a second logic level when the at least one main loop of the first Sterba Curtain is closed.

15. The system of claim 1, wherein the first reflected component of the first incident electromagnetic wave is increased relative to the first transmitted component of the first incident electromagnetic wave when the at least one main loop of the first Sterba Curtain is closed by the first modulating device.

16. The system of claim 1, wherein the first transmitted component of the first incident electromagnetic wave is increased relative to the first reflected component of the first incident electromagnetic wave when the at least one main loop of the first Sterba Curtain is opened by the first modulating device.

17. The system of claim 1, wherein the first reflected component of the first incident electromagnetic wave is increased relative to the first transmitted component of the first incident electromagnetic wave when the at least one main loop of the first Sterba Curtain is closed by the first modulating device; and wherein the first transmitted component of the first incident electromagnetic wave is increased relative to the first reflected component of the first incident electromagnetic wave when the at least one main loop of the first Sterba Curtain is opened by the first modulating device.

18. The system of claim 17, wherein the first logic level is high when the second logic level is low and the second logic level is high when the first logic level is low.

* * * * *